US006525456B1

(12) United States Patent
Kim

(10) Patent No.: US 6,525,456 B1
(45) Date of Patent: Feb. 25, 2003

(54) DAMPER WIRE FOR SHADOW MASK IN FLAT BRAUN TUBE

(75) Inventor: Sung Dae Kim, Taegu-shi (KR)

(73) Assignee: LG Electronics Inc., Seoul (KR)

( * ) Notice: Subject to any disclaimer, the term of this patent is extended or adjusted under 35 U.S.C. 154(b) by 61 days.

(21) Appl. No.: 09/689,869

(22) Filed: Oct. 13, 2000

(30) Foreign Application Priority Data

Oct. 15, 1999 (KR) ..... 99-44821

(51) Int. Cl.[7] ..... H01J 29/81

(52) U.S. Cl. ..... 313/402; 313/403

(58) Field of Search ..... 313/402, 403, 313/404, 405, 406, 407, 408

(56) References Cited

U.S. PATENT DOCUMENTS 5,394,051 A * 2/1995 Lerner ..... 313/403

* cited by examiner

*Primary Examiner*—Ashok Patel
*Assistant Examiner*—Thelma Sheree Clove
(74) *Attorney, Agent, or Firm*—Fleshner & Kim, LLP

(57) ABSTRACT

Damper wire for a shadow mask in a flat Braun tube including a shadow mask, a support for supporting the shadow mask under a tension, a damper wire fitted to the support in contact with a surface of the shadow mask, wherein, the damper wire satisfies a condition expressed in an equation, $T<\pi\rho L^2F^2_{n\text{-}s/m}$, where T denotes a tension of damper wire, ρ denotes mass per unit length, L denotes a total length, and $f_{n\text{-}s/m}$ denotes a first natural frequency of the shadow mask, thereby preventing breakage of the damper wire, but still enhancing an attenuation efficiency.

24 Claims, 6 Drawing Sheets

DAMPER WIRE FOR SHADOW MASK IN FLAT BRAUN TUBE

BACKGROUND OF THE INVENTION

1. Field of the Invention

The present invention relates to a shadow mask in a flat Braun tube, more particularly, to a damper wire for a shadow mask in a flat Braun tube for prevention of vibration of the shadow mask occurred by an external vibration.

2. Background of the Related Art

In the flat Braun tube, electron beams emitted from the electron gun pass through electron beam pass through holes in the shadow mask selectively, and hit a fluorescent film surface on an inside surface of a panel, for reproducing a picture by making the fluorescent film surface luminescent. In view of a nature of the shadow mask, the shadow mask is designed to have a radius of curvature corresponding to the panel of the Braun tube. As a related art shadow mask with a spherical panel in a Braun tube has a small radius of curvature following the spherical panel, a shape of the shadow mask itself could have an adequate rigidity against deformation. According to this, the howling was not serious, in which electron beams misland on a screen owing to vibration of the shadow mask caused by an external vibration. However, as the panel becomes flat with an increase of the radius of curvature, the recent shadow mask can not have an adequate rigidity against deformation identical to the related art shadow mask having a smaller radius of curvature. According to this, the howling becomes serious owing to the external vibration, which deteriorates a color purity of the picture. Of various vibration attenuation devices suggested for solving the shadow mask vibration, a method for bringing a damper wire into contact with the shadow mask for attenuation of the vibration for attenuation of the vibration is widely used. FIG. 1 illustrates a longitudinal section of a related art flat Braun tube having a damper wire applied to a shadow mask.

Referring to FIG. 1, the related art flat Braun tube is provided with a panel 1 forming a front face of the flat Braun tube, a fluorescent film 2 of red, green, blue dots coated on an inside surface of the panel 1, a funnel 3 welded to rear of the panel 1, an electron gun 5 sealed in a neck part 4 of the funnel 3 for emission of three electron beams 6, a deflection yoke 9 for deflecting the electron beams 6 emitted from the electron guns 5 in an up, down, left or right direction, a shadow mask 7 having a plurality of electron beam pass through holes 10 for passing the electron beams 6 selectively, a rail 8, a rectangular support, attached to an inside of the panel 1 for supporting the shadow mask 7 so as to exert a tension to the shadow mask 7, and a plurality of damper wires 11 each for strapping the shadow mask 7 through a portion of the shadow mask 7 between the electron beam pass through holes 10 under a tension with each end fixed to one side of the rail 8.

FIG. 2 illustrates a section across line I—I in FIG. 1 for showing a relation between the damper wire and the shadow mask, and FIG. 3 illustrates a section across line II—II in FIG. 2 for showing how the damper wire 11 attenuates vibration of the shadow mask 7.

Referring to FIG. 2, the damper wire 11 is in contact with the shadow mask 7 over an entire length of the damper wire 11 in parallel to a vertical side of the rail 8. And, the tension of the damper wire 11 is set stronger than the shadow mask 7. It means that a natural frequency of the shadow mask 7 is lower than a natural frequency of the damper wire 11 according to an equation (1) shown in the detailed description of preferred embodiments of the present invention. Therefore, as shown in FIG. 3, when a vibration is transmitted from the flat Braun tube, the damper wire 11 vibrates faster than the shadow mask 7. The difference of vibration between the shadow mask 7 and the damper wire 11 causes the shadow mask 7 and the damper wire 11 to collide to each other, by which the vibration of the shadow mask 7 is attenuated. The tension of the damper wire 11 is set stronger than the same of the shadow mask 7, for exerting a stronger resistance to the shadow mask 7 when the shadow mask 7 hits the damper wire 11 during vibration to attenuate the vibration, effectively. However, excessively strong damper wire tension breaks the damper wire 11, thereby dropping a Braun tube production efficiency.

SUMMARY OF THE INVENTION

Accordingly, the present invention is directed to a damper wire for a shadow mask in a flat Braun tube that substantially obviates one or more of the problems due to limitations and disadvantages of the related art.

An object of the present invention is to provide a damper wire for a shadow mask in a flat Braun tube, which has a weak tension for prevention of breakage of the damper wire, but still can enhance an attenuation efficiency.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the damper wire for a shadow mask in a flat Braun tube includes a shadow mask, a support for supporting the shadow mask under a tension, a damper wire fitted to the support in contact with a surface of the shadow mask, wherein, the damper wire satisfies a condition expressed in an equation, $T<\pi\rho L^2 f^2_{n\text{-}s/m}$, where T denotes a tension of damper wire, ρ denotes mass per unit length of the damper wire, L denotes a total length of the damper wire, and $f_{n\text{-}s/m}$ denotes a first natural frequency of the shadow mask.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
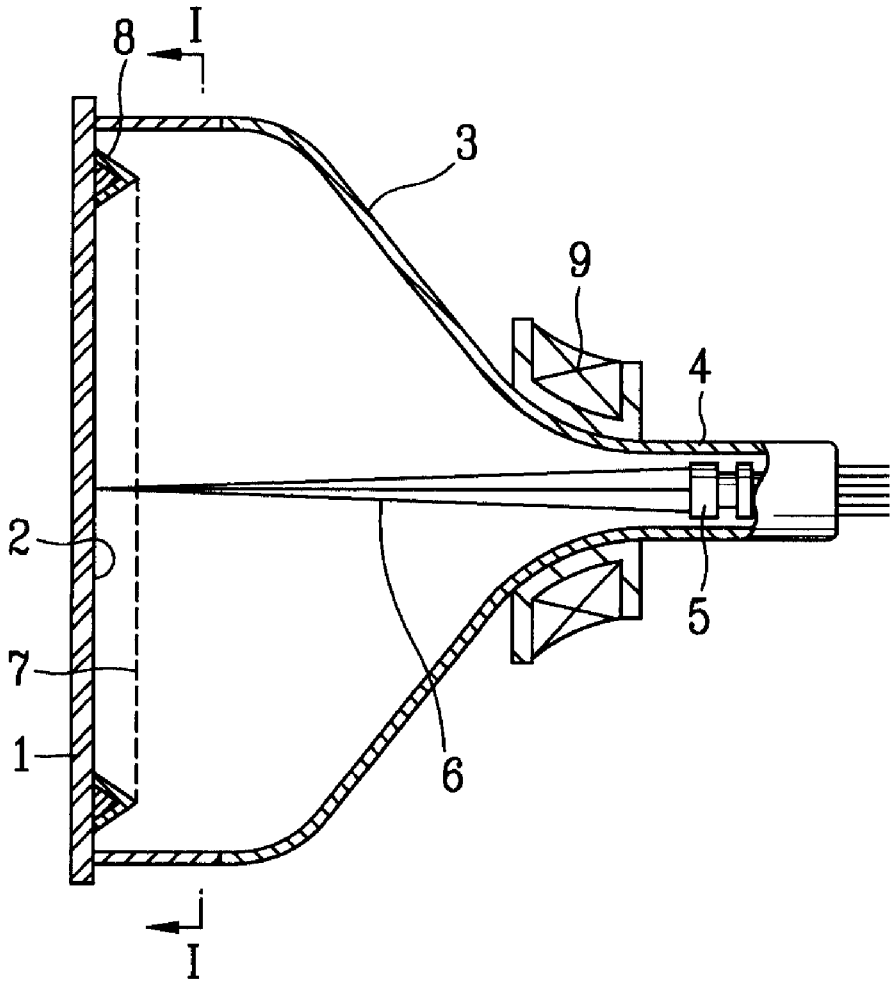
FIG.1 Prior Art
FIG. 1 illustrates a longitudinal section of a related art flat Braun tube having a damper wire applied to a shadow mask.
Figure 2:
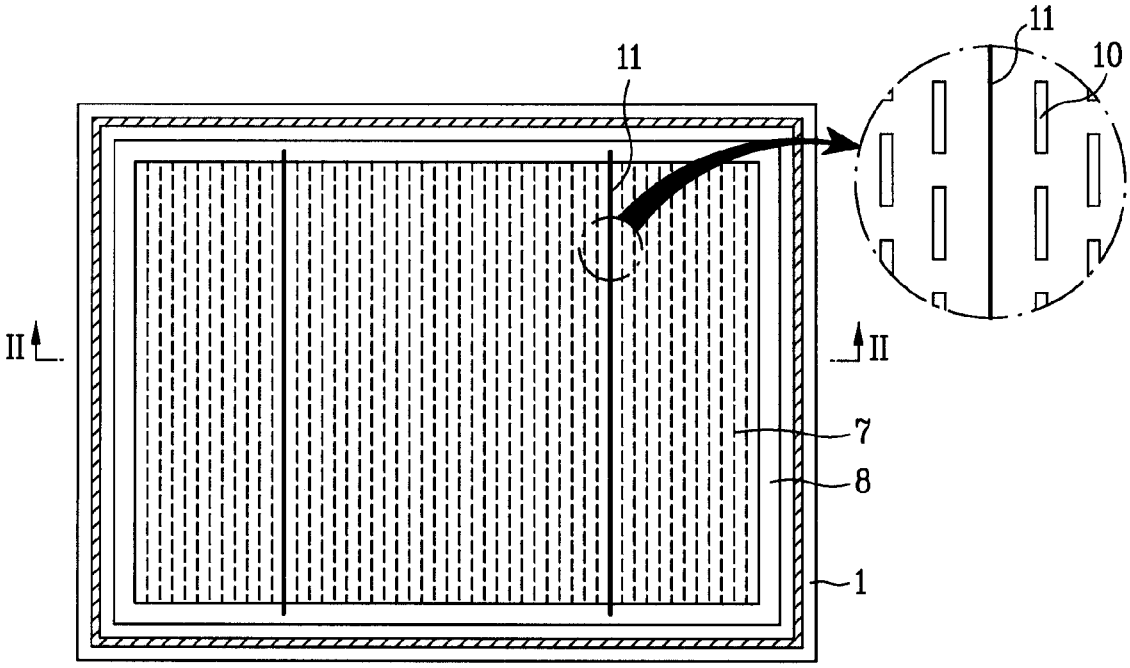
FIG.2 Prior Art
FIG. 2 illustrates a section across line I—I in FIG. 1 for showing a relation between the damper wire and the shadow mask.
Figure 3:
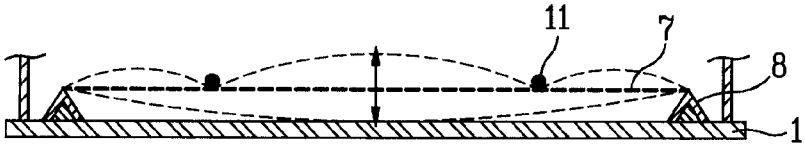
FIG.3 Prior Art
FIG. 3 illustrates a section across line II—II in FIG. 2 for showing how the damper wire 11 attenuates vibration of the shadow mask 7.

Reference will now be made in detail to the preferred embodiments of the present invention, examples of which are illustrated in the accompanying drawings. The damper wire for a shadow mask in a flat Braun tube of the present invention has the same system and vibration attenuation principle with the related art damper wire. Therefore, in the present invention, the system of the damper wire of the present invention will be omitted, and components of the damper wire of the present invention identical to the related art damper wire will be given the same reference symbols. The present invention suggests a range of tension of a damper wire which is weaker than the related art, but can make an optimum attenuation of vibration of the shadow mask.

A process for fixing a tension range of the damper wire of the present invention will be explained.

A first natural frequency $f_{n\text{-}wsire}$(Hz) of the damper wire is proportional to a tension of the damper wire 11 given for suppressing vibration of the shadow mask 7 as shown in an equation (1), below.

$$f_{n\text{-}wire} = \pi\sqrt{\frac{T}{\rho L^2}} \tag{1}$$

Where, T denotes a tension on the damper wire(Newton), ρ denotes mass per unit length of the damper wire(kg/m), L denotes a length of the damper wire.

The tension on the damper wire 11 varies with many factors, such as a thickness of the damper wire 11, material, and a size of the shadow mask 7. In detail, the tension of the damper wire 11 can be can be fixed, by fixing, at first, the first natural frequency of the shadow mask 7 which is an object of the vibration attenuation, at second, a first natural frequency of the damper wire 11 with reference to the first natural frequency of the shadow mask 7, and, at third, the tension of the damper wire 11 according to the first natural frequency of the damper wire 11. According to the equation (1), as the tension is proportional to the vibration, when it is intended to reduce the tension on the damper wire 11, vibration of the damper wire 11 should be reduced. Though the vibration frequency of the related art damper wire 11 is higher than the shadow mask 7, in a case of the damper wire 11 of the present invention, the vibration frequency of the damper wire 11 of the present invention is set lower than the same of the shadow mask 7. That is, the tension on the damper wire 11 can be obtained from an equation (2), which is a rearrangement of the equation (1).

$$T < \pi\rho L^2 f_{n\text{-}s/m}^2, \tag{2}$$

where $f_{n\text{-}s/m}$ denotes a first natural frequency of the shadow mask 7.

Accordingly, the tension on the damper wire is fixed as follows.

First, the first natural frequency of the shadow mask 7 of the present invention is fixed to be 78 Hz, which is a natural frequency of a general shadow mask 7.

Second, the first natural frequency of the damper wire 11 corresponding to the first natural frequency of the shadow mask 7 is substituted with a value lower (43 Hz) than the first natural frequency of the shadow mask 7, the same 78 Hz with the first natural frequency of the shadow mask 7, or higher 113 Hz and 139 Hz than the first natural frequency of the shadow mask 7. Then, a first optimal natural frequency of the damper wire 1 I which makes vibration of the shadow mask 7 the smallest is found out from a first vibration analysis model for verifying action of the damper wire and a result of the vibration analysis, and a test model for testing a performance of a damper wire and a result of a vibration analysis of the shadow mask.

Third, the tension on the damper wire 11, which is an object of the present invention, is obtained from the optimal first natural frequency of the damper wire 11 by using the equation (2). Variation of the vibration of the shadow mask 7 with reference to the foregoing natural frequencies of the damper wire 11 will be explained with reference to FIGS. 4A~5B.

The first vibration analysis model will be explained.

In the first vibration analysis model, it is assumed that $m_1$ denotes mass, $c_1$ denotes a damping coefficient, and $k_1$ denotes a rigidity of the shadow mask 7, and $m_2$ denotes mass, $c_2$ denotes a damping coefficient, and $k_2$ denotes a rigidity of the damper wire 11. In this instance, as both of the damper wire 11 and the shadow mask 7 are fastened, both are considered to have independent one degree of freedoms, and the process of collision occurrence between the damper wire 7 and the shadow mask 11 is analyzed by using a concept of coefficient of restitution. And, assuming that the external vibration is given to the shadow mask 7 at first, a behaviour of vibration attenuation of the shadow mask 7 as time goes by is assessed analytically with reference to a time when an initial vibration is given to the mass m, of the shadow mask 7.

The order of analysis is as follows.

1) Give an initial vibration to the shadow mask→2) Natural vibration of the shadow mask→3) Collision between the shadow mask and the damper wire→4) restitution between the shadow mask and the damper wire→5) individual natural vibration→6) return to 3). In this instance, the two components before and after collision move in forms of completely independent natural vibrations, which can be expressed in a natural vibration model expressed in the following equation (3).

For mask system: $m_1x''_1+c_1x'_1+k_1x_1=0$.

For wire system: $m_2x''_2+c_2x'_2k_2x_2=0$.

And, as expressed in an equation (4) below, it is assumed that the motion is governed by the coefficients of restitutions and the conservation of momentum at the moment of collision, taking only a mass effect into account, without any influences from respective rigidities or damping effect.

At collision: $x_2-x_1 \leqq \epsilon$, speed before collision: $v_1(t)$, $v_2(t)$, speed after collision: $v_1(t+\Delta t))$, $v_2(t+\Delta t)$.

Conservation of momentum: $m_1v_1(t)+m_2v_2(t)=m_1v_1(t+\Delta t)+m_2v_2(t+\Delta t)$ Coefficient of restitution: $e=[v_2(t+\Delta t)-v_1(t+\Delta t)]/[v_2(t)-v_2(t)]$, Therefore, $v_1(t+\Delta t)=x_1(t+\Delta t)=[1/(m_1+m_2)]\{-m_2e[x_1(t)-x_2(t)]+m_1x_1(t)+m_2x_2(t)\}$, and $v_2(t+\Delta t)=x_2(t+\Delta t)=[1/(m_1+m_2)]\{m_1e[x_1(t)-x_2(t)]+m_1x_1(t)+m_2x_2(t)\}$, where, $x_1$ denotes an amplitude of displacement(variation of vibration) of the shadow mask 7, and $x_2$ denotes displacement(variation of vibration) of the damper wire 11.

Figure 4A:
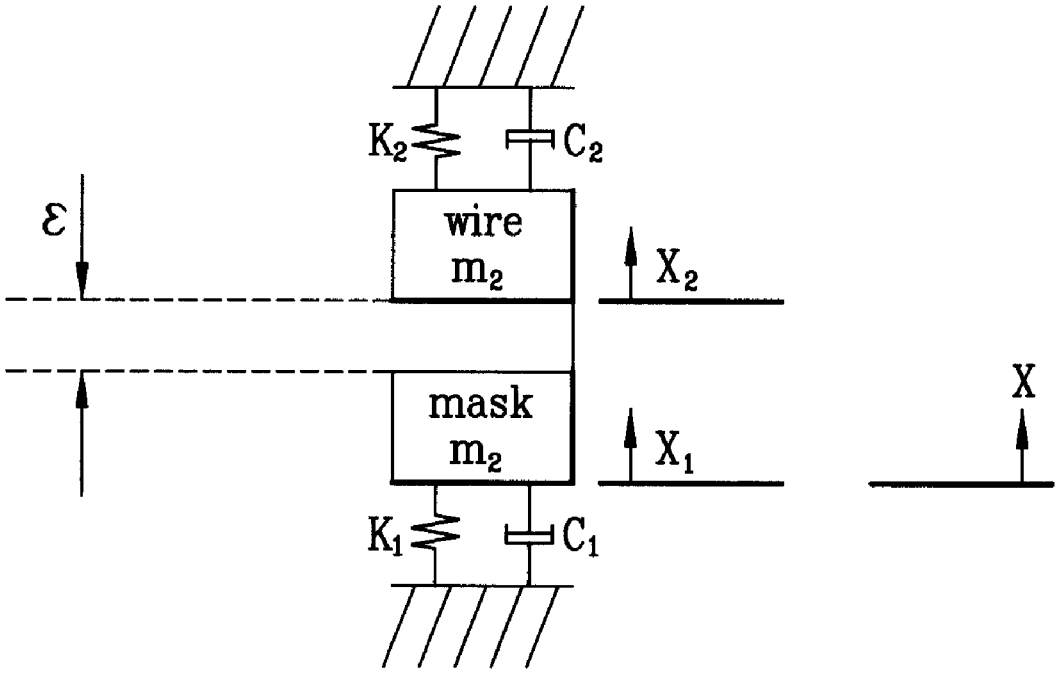
FIG. 4A illustrates a vibration analysis model for verifying action of the damper wire for a shadow mask in a flat Braun tube in accordance with a preferred embodiment of the present invention, schematically.
Figure 4B:
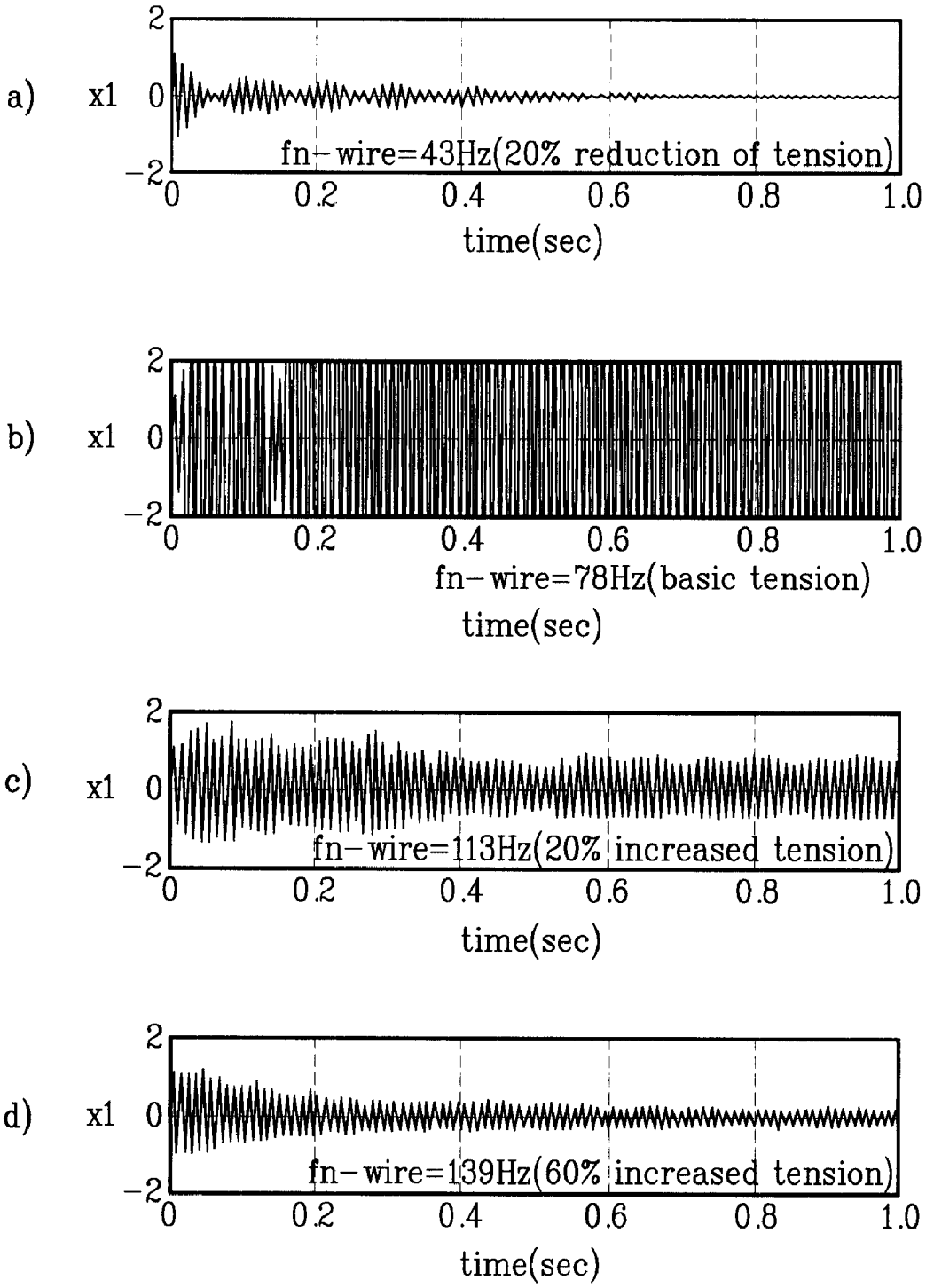
FIG. 4B illustrates a simulation result of the vibration analysis in FIG. 4A.

Referring to FIG. 4B, FIG. 4B-(*b*) illustrates a case when the first natural frequency of the damper wire 11 is set to be equal to the first natural frequency of the shadow mask(78 Hz), where amplitudes of the damper wire 11 and the shadow mask 7 are added together. FIG. 4B-(*a*) illustrates a case when the first natural frequency of the damper wire 11 is set to be smaller than a base natural frequency(the first natural frequency) by 35 Hz(i.e., in a 55% range of the base natural frequency of the shadow mask), and FIG. 4B-(*c*) illustrates a case, opposite to the case of FIG. 4B-(*a*), when the first natural frequency of the damper wire 11 is set to be greater than the base natural frequency by 35 Hz(i.e., in a 149% range of the base natural frequency of the shadow mask). Variations of vibration frequencies of the damper wire in the case of FIGS. 4B-(*a*) and (*c*) can be scaled to variations of tensions, to show the variations to be approx. 20% as shown in FIG. 4B. FIG. 4B-(*d*) illustrates a case when the first natural frequency of the damper wire 11 is set to be 139 Hz(60% tension increase), significantly greater than the base natural frequency. From a result of vibration under the foregoing conditions, it can be known that a vibration attenuation in the case of FIG. 4B-(*a*) is significantly greater than the same of the FIG. 4B-(*c*). Though the vibration is attenuated fully in approx. 0.7 seconds in the case of FIG. 4B-(*a*), the vibration is not attenuated substantially in the case of FIG. 4B-(*c*). In the case of FIG. 4B-(*b*), as a probability of collision between the damper wire 11 and the shadow mask 7 caused by the vibration is minimized, the damper wire 11 accelerates vibration of the shadow mask 7, on the contrary, to affect to the vibration. Though the vibration attenuation is greater than the case of FIG. 4B-(*c*), the case of FIG. 4B-(*d*) has a high probability of damper wire 11 breakage owing to an increased tension of the damper wire 11, and can not give a vibration attenuation effect as much as the case of FIG. 4B-(*a*) despite of such as a high probability of damper wire breakage. In summary, it can be known that the vibration attenuation effect by the shadow mask 7 is better in the case the natural vibration frequency of the damper wire 11 is set to be smaller than a certain amount with reference to the first natural vibration frequency of the shadow mask 7 than in the case the natural vibration frequency of the damper wire 11 is set to be greater than the same amount with reference to the first natural vibration frequency of the shadow mask 7. In this instance, though an extent of a tension adjustment should be within a range in which vibration of the shadow mask 7 is attenuated to the maximum by setting the first natural frequency of the damper wire 11 as low as possible, since too loose tension may impair a function of the damper wire 11 fully, a lower limit of the tension should be taken into account in design.

The case of the second vibration analysis model will be explained.

Figure 5A:
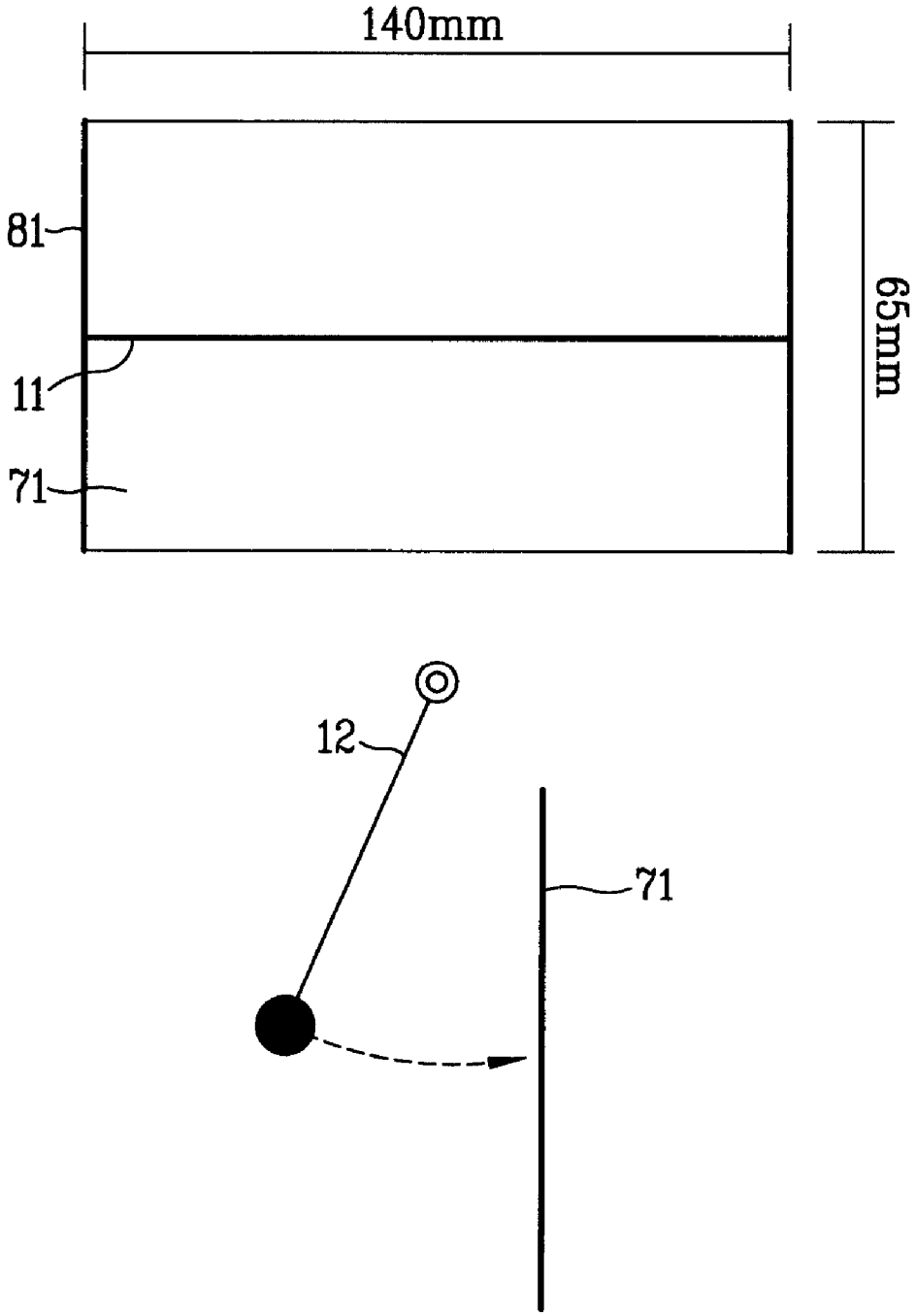
FIG. 5A illustrates a test model for testing a performance of a damper wire for a shadow mask in a flat Braun tube in accordance with a preferred embodiment of the present invention, schematically; and, FIG. 5B illustrates a result of a vibration analysis of a rubber plate for the shadow mask in FIG. 5A.

In the case of the second vibration analysis model, the experiment is conducted by using a thin rubber plate 71 with a size of 140 mm×65 mm in place of the shadow mask 7 as shown in FIG. 5A, for verification of the experimental result of the first vibration analysis model, wherein the rubber plate 71 are uniformly fixed with steel bars at both sides thereof, and is given a tension to the rubber plate 71 by pulling the steel bars in opposite directions, and is made to vibrate by means of a pendulum 12.

Figure 5B:
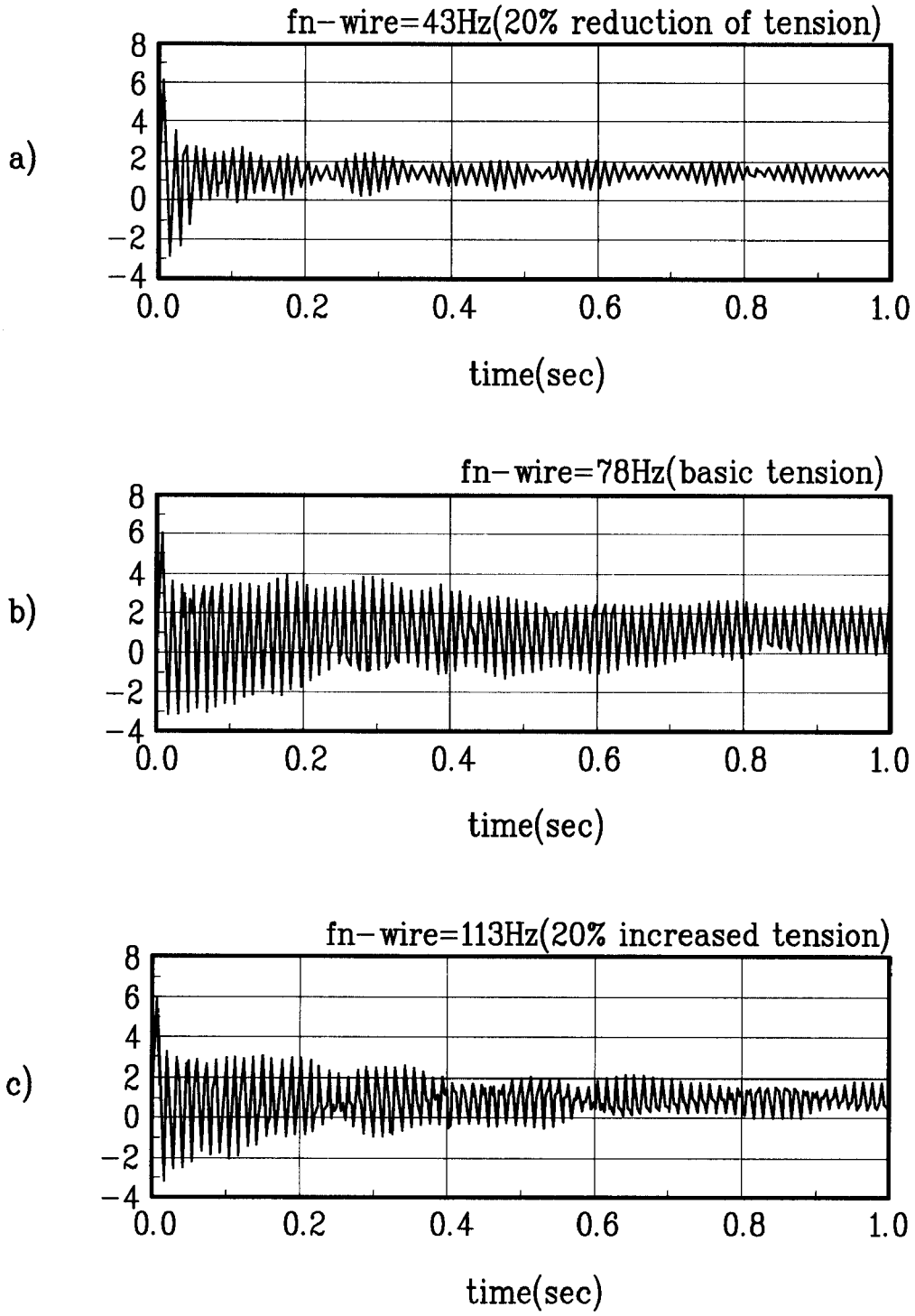

Referring to FIG. 5B, alike the first vibration analysis model, FIG. 5B-(*b*) illustrates a case when the first natural frequency of the damper wire 11 is set to be equal to the first natural frequency of the shadow mask(78 Hz). FIG. 4B-(*a*) illustrates a case when the first natural frequency of the damper wire 11 is set to be smaller than a base natural frequency by 35 Hz(i.e., in a 55% range of the base natural frequency of the shadow mask and reduced by 20% from the basic tension), and FIG. 4B-(*c*) illustrates a case, opposite to the case of FIG. 4B-(*a*), when the first natural frequency of the damper wire 11 is set to be greater than the base natural frequency by 35 Hz(i.e., in a 149% range of the base natural frequency of the shadow mask and reduced by 20% from the basic tension). It can be known from the above vibration experiment result, that setting the natural vibration frequency of the damper wire lower than the same of the shadow mask as shown in FIG. 5B-(*a*) shows a vibration attenuation effect in a range of 40–50% than setting the natural vibration frequency of the damper wire higher than the same of the shadow mask as shown in FIG. 5B-(*b*).

As has been explained, the damper wire for a shadow mask in a flat Braun tube of the present invention has the following advantages.

A probability of collision between the damper wire and the shadow mask can be made to increase, which can attenuate vibration of the shadow mask significantly in comparison to the same in the related art, that improves a howling characteristic, by adjusting the tension of the damper wire such that the first natural frequency of a plurality of damper wire is lower than the first natural frequency of the shadow mask. That is, the present invention corrects the misunderstanding of the common sense in the related art that setting a tension of the damper wire higher than a tension corresponding to a natural vibration frequency of the damper wire would provide a greater vibration attenuation effect of the shadow mask, and proves as a result of simulation and experiment that, contrary to the above common sense, setting the tension of the damper wire lower than the tension corresponding to the natural vibration frequency of the damper wire provides a greater vibration attenuation effect of the shadow mask. Accordingly, the reduction of an excessive tension to the damper wire can prevent breakage of the damper wire in advance.

It will be apparent to those skilled in the art that various modifications and variations can be made in the damper wire for a shadow mask in a flat Braun tube of the present invention without departing from the spirit or scope of the invention. Thus, it is intended that the present invention cover the modifications and variations of this invention provided they come within the scope of the appended claims and their equivalents.

What is claimed is:

1. A damper wire for a shadow mask, wherein a first natural frequency of the damper wire is lower than a first natural frequency of the shadow mask.

2. A shadow mask assembly, comprising:

a shadow mask;

a support for supporting the shadow mask under a tension; and a damper wire fitted to the support in contact with a surface of the shadow mask, wherein, the damper wire satisfies a condition expressed in the equation, $T<\Pi\rho L^2 f^2_{n\text{-}s/m}$ where T denotes a tension of damper wire, ρ denotes mass per unit length, L denotes a total length, and $f_{n\text{-}s/m}$ denotes a first natural frequency of the shadow mask.

3. The shadow mask assembly as claimed in claim 2, wherein the contact is straight and parallel to the shadow mask.

4. The shadow mask assembly as claimed in claim 2, wherein the tension on the damper wire is lower than a tension corresponding to a first natural frequency of the damper wire.

5. The shadow mask assembly as claimed in claim 4, wherein the tension on the damper wire is 20% lower than a tension corresponding to a first natural frequency of the damper wire.

6. The damper wire as claimed in claim 1, wherein the first natural frequency of the damper wire is 55% of the first natural frequency of the shadow mask.

7. The damper wire as claimed in claim 1, wherein the damper wire is configured for a shadow mask in a flat Braun tube.

8. The damper wire as claimed in claim 1, wherein the damper wire satisfies the following equation:

$$T<\Pi\rho L^2 f^2_{n\text{-}s/m}$$

where T denotes a tension of damper wire, p denotes mass per unit length, L denotes a total length, and $f_{n\text{-}s/m}$ denotes a first natural frequency of the shadow mask.

9. The shadow mask assembly as claimed in claim 2, wherein a first natural frequency of the damper wire is lower than a first natural frequency of the shadow mask.

10. The shadow mask assembly as claimed in claim 9, wherein the first natural frequency of the damper wire is 55% of the first natural frequency of the shadow mask.

11. The shadow mask assembly as claimed in claim 2, wherein the shadow mask assembly is configured for a shadow mask in a flat Braun tube.

12. A CRT including the shadow mask assembly of claim 2.

13. An improved damper wire for a shadow mask assembly, the shadow mask assembly including a shadow mask, a support for supporting the shadow mask under a tension, and a damper wire fitted to the support in contact with a surface of the shadow mask, the improvement comprising:

wherein the damper wire satisfies the following equation:

$$T<\Pi\rho L^2 f^2_{n\text{-}s/m}$$

where T denotes a tension of the damper wire, p denotes mass per unit length, L denotes total length, and $f_{n\text{-}s/m}$ denotes a first natural frequency of the shadow mask.

14. The improved damper wire as claimed in claim 13, wherein the contact is straight and parallel to the shadow mask.

15. The improved damper wire as claimed in claim 13, wherein the tension on the damper wire is lower than a tension corresponding to a first natural frequency of the damper wire.

16. The improved damper wire as claimed in claim 15, wherein the tension on the damper wire is 20% lower than a tension corresponding to a first natural frequency of the damper wire.

17. The improved damper wire as claimed in claim 13, wherein a first natural frequency of the damper wire is lower than a first natural frequency of the shadow mask.

18. The improved damper wire as claimed in claim 17, wherein the first natural frequency of the damper wire is 55% of the first natural frequency of the shadow mask.

19. The improved damper wire as claimed in claim 13, wherein the damper wire is configured for a shadow mask in a flat Braun tube.

20. A shadow mask assembly, comprising:

a shadow mask;

a support for supporting the shadow mask under a tension; and a damper wire fitted to the support in contact with a surface of the shadow mask, wherein a first natural frequency of the damper wire is lower than a first natural frequency of the shadow mask.

21. The shadow mask assembly as claimed in claim 20, wherein first natural frequency of the damper wire is 55% of the first natural frequency of the shadow mask.

22. The shadow mask assembly as claimed in claim 20, wherein the damper wire is configured for a shadow mask in a flat Braun tube.

23. A CRT including the shadow mask assembly of claim 20.

24. The shadow mask assembly as claimed in claim 20, wherein the damper wire satisfies the following equation:

$$T<\Pi\rho L^2 f^2_{n\text{-}s/m}$$

where T denotes a tension of damper wire, p denotes mass per unit length, L denotes a total length, and $f_{n\text{-}s/m}$ denotes a first natural frequency of the shadow mask.

* * * * *